US007381086B1

(12) United States Patent
Gilmore et al.

(10) Patent No.: US 7,381,086 B1
(45) Date of Patent: Jun. 3, 2008

(54) HIGH RELIABILITY BATTERY CONTACT ASSEMBLY AND METHOD OF FORMING SAME

(75) Inventors: Peter B. Gilmore, Plantation, FL (US); David H. McClintock, Georgetown (MY); Robert J. Mulligan, Coral Spring, FL (US); Bok Yeam Ong, Georgetown (MY)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/670,252

(22) Filed: Feb. 1, 2007

(51) Int. Cl.
*H01R 3/00* (2006.01)

(52) U.S. Cl. ..... 439/500

(58) Field of Classification Search ..... 439/500, 439/660, 701, 66, 862, 637, 636, 736, 626, 439/630, 885, 108, 96, 98
See application file for complete search history.

(56) References Cited

U.S. PATENT DOCUMENTS

| | | | | |
|---|---|---|---|---|
| 6,068,519 | A * | 5/2000 | Lok | 439/660 |
| 6,113,440 | A * | 9/2000 | Fijten et al. | 439/862 |
| 6,702,621 | B2 * | 3/2004 | Yeh | 439/660 |
| 2003/0224837 | A1 * | 12/2003 | Kuriyama et al. | 455/575.1 |

* cited by examiner

*Primary Examiner*—Edwin A. León
(74) *Attorney, Agent, or Firm*—Barbara R. Doutre

(57) ABSTRACT

A high reliability battery contact assembly (100) for use in an electronic device includes a battery contact block (103) comprised of a plurality of cantilevered contacts (105, 107, 109). A redundant ground contact (111) is connected to the metallic housing of the electronic device (101) and positioned adjacent to the battery contact block (103). The cantilevered contacts include a primary power contact (105), a sensing contact (107) and a ground contact (109). The battery contact assembly (100) is advantageous in that it requires a very limited amount of surface area while still working to prevent a reset condition of an electronic device that might occur due to a loss in electrical continuity during adverse conditions.

19 Claims, 3 Drawing Sheets

HIGH RELIABILITY BATTERY CONTACT ASSEMBLY AND METHOD OF FORMING SAME

FIELD OF THE INVENTION

The present invention relates generally to battery contacts and, more particularly, to a battery contact assembly for maintaining circuit continuity.

BACKGROUND

Electronic portable devices typically use some form of removable battery pack for powering the device. Cantilever spring battery contacts are often used to bring power from the removable battery pack to a printed circuit (PC) board located in the device. Based on a range of design tolerances, these springs have a minimum beam length and height. Due to the nature of the springs these contacts can take up valuable PC board space. An example of this type of electronic device is a two-way radio transceiver.

One problem associated with battery packs of this type occurs when they are subjected to adverse conditions such as a fall or drop onto a hard surface. This subjects the battery pack and its associated electrical contacts to such high "g" loads that the impact often temporarily disconnects the battery from the electronic device. This, inturn, can cause a condition often referred to as "reset" where information stored in static memory may be lost during the time this discontinuity occurs. Moreover, in situations where these types of batteries are used in public safety applications, such as a two-way radio transceiver for police and fire personnel, the transceiver may be in an "off" state where the user is unaware of this situation and important communications could be missed. Although redundant battery contacts have been used in battery packs of the prior art, this solution often requires a great deal of physical space making the battery contact area larger than can be accepted for required design parameters.

Accordingly the need exists for a battery contact assembly having high reliability that requires a limited amount of surface area for preventing reset conditions of an electronic device in adverse conditions.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
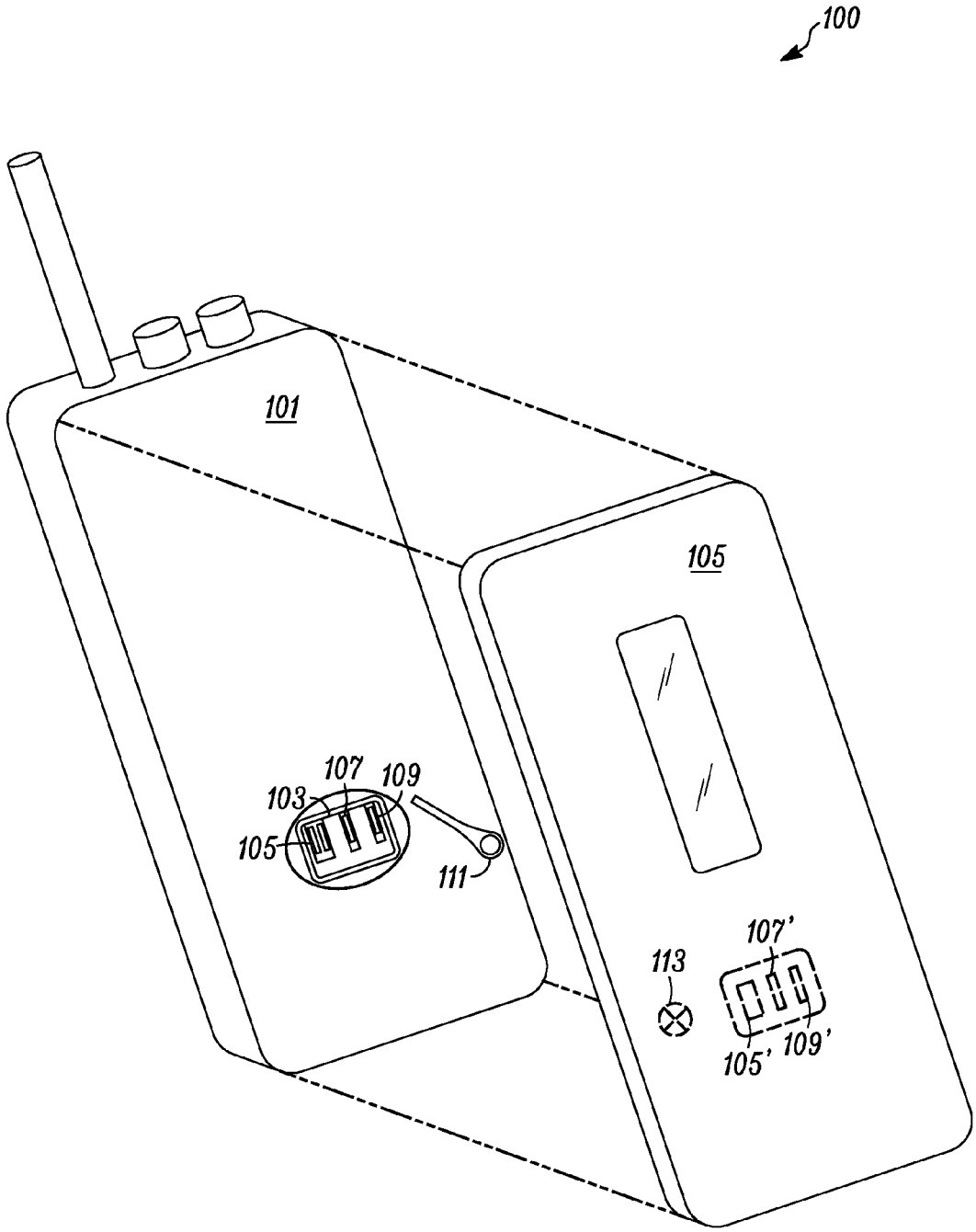
FIG. 1 illustrates an exploded view of radio housing with battery contact block and accompanying battery in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a battery contact assembly. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 illustrates an exploded view of radio assembly 100 including a radio housing 101 with battery contact block 103 and accompanying battery housing 105 in accordance with an embodiment of the invention. The contact block 103 is exposed through an aperture in the housing 105. The contact block 103 includes a primary power contact 105, a sense contact 107 and a ground contact 109. In order to provide a high degree of reliability during a drop condition of the device, a redundant ground contact 111 is provided for contacting a portion of the battery housing 105.

As seen in FIG. 1, the redundant ground contact 111 is mechanically fastened to a metallic portion of the radio housing 101 and may be in the form of a lug or resilient terminal that projects away from the surface of the radio housing 101. This provides a ground contact which makes a good mechanical ground with the battery housing 105 when they are both engaged in a unitary manner (not shown). The battery housing 105 includes a plurality of corresponding contacts including a primary battery contact 105', a sense contact 107' and a ground contact 109'. A screw 113 or other type of metallic fastener on the battery may be used to make contact with the redundant ground contact 111.

Figure 2:
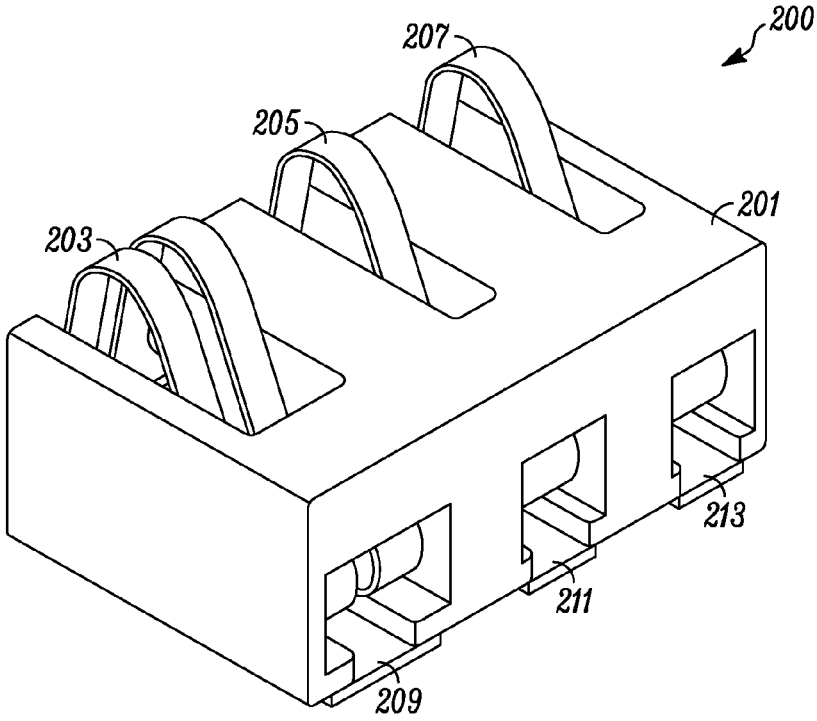
FIG. 2 illustrates a perspective view of the battery contact block as shown in FIG. 1.

FIG. 2 illustrates a magnified prospective view of the battery contact block 200. The contact block 200 includes a substantially rectangular base 201 made of a hardened plastic or other non-conductive material. The contact block includes a plurality of cantilevered contacts providing resilient or spring-like action when in a compressed position. As described in FIG. 1, the rectangular base 201 includes a primary contact 203 which is comprised of a double cantilevered contact to provide redundancy in a high stress or drop condition of the device. A sensing contact 205 is a single cantilevered contact that works to convey operational and control information to and from the battery. This information might relate to such parameters as battery charge level, charge state and/or condition.

A grounding contact 207 is a single cantilevered contact used to provide a ground return path. In order to keep the overall size of the contact block 201 as small as possible, the ground contact 207 is made as only a single unitary contact with additional redundancy for the ground return available through the redundancy ground contact 111. Those skilled in the art will recognize that the primary contact 203, sensing contact 205 and grounding contact 207 may each be connected directly to a printed circuit board through connecting points 219, 211, 213 or may be connected using fasteners or direct wire connections.

Figure 3:
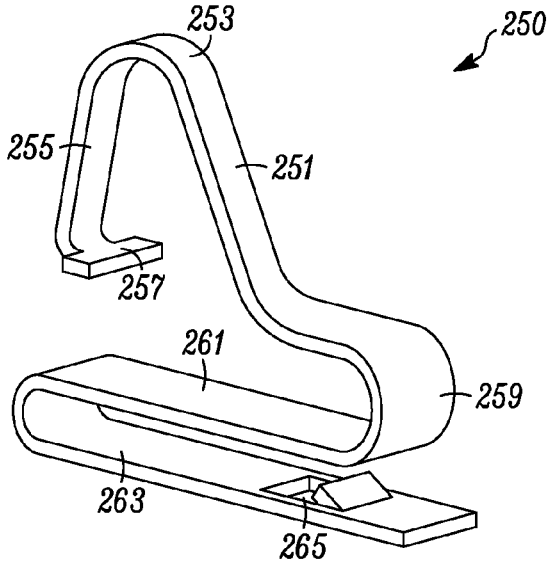
FIG. 3 illustrates a perspective view of a cantilevered contact in accordance with an embodiment of the invention.
Figure 4:
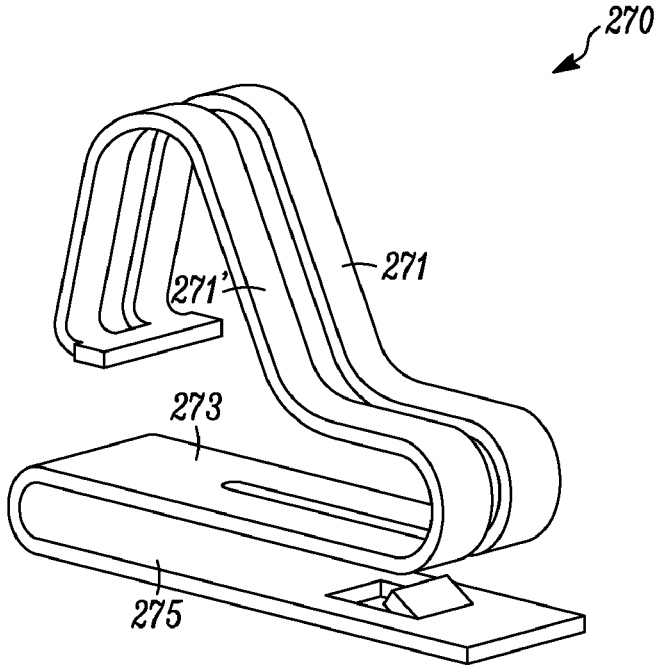
FIG. 4 illustrates a perspective view of a double cantilevered contact in accordance with an embodiment of the invention.
Figure 5:
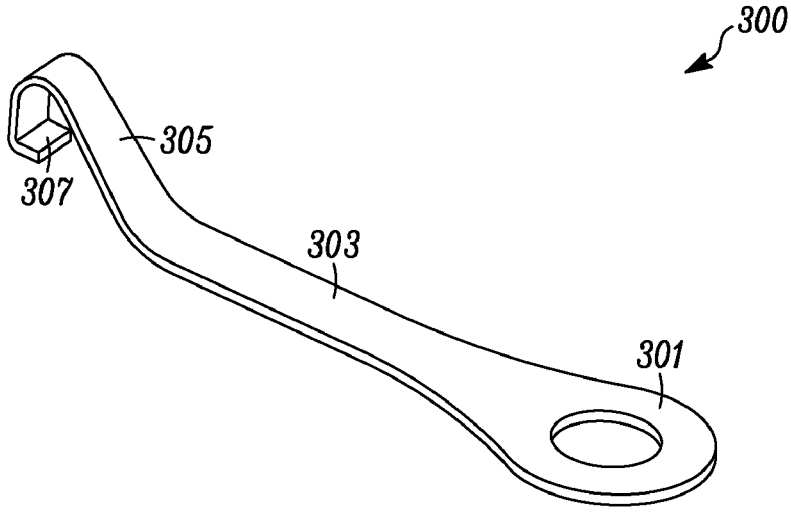
FIG. 5 illustrates a perspective view of the redundant ground contact in accordance with an embodiment of the invention.

Finally, FIG. 3 illustrates a perspective view of a cantilevered contact in accordance with an embodiment of the invention. The cantilevered contact 250 is typically a flat wire material which is rigid and electrically conductive. The contact 250 includes a protruding contact portion 251 which is bent at a top edge 253 where a lower edge 255 is folded under the top edge 253. The lower edge 255 is further bent into a flat section 257. The contact portion 251 connects with a u-shaped fastener portion 259. The fastener portion 253 is formed from an upper fastener 261 and a lower fastener 263. The lower fastener 263 includes an engaging aperture 265 enabling the lower fastener 263 to engage with a locking member (not shown) located within the contact block 200 for holding the contact 250 into a fixed position. FIG. 4 illustrates a perspective view of a double cantilevered contact 270. The double cantilevered contact 270 is like that of FIG. 3 except for a double protruding contact portion 271, 271' and a wider upper fastener 273 and lower fastener 275. FIG. 5 illustrates the magnified perspective view of a redundant ground contact 300. The redundant ground contact 300 is made of a substantially flat conductive material that includes a lug section 301, tapered section 303, contact section 305 and end section 307.

Thus, the present invention is a high reliability battery contact assembly which solves the problem of providing battery power contact redundancy in a substantially small battery contact header. The contact block includes redundant power (B+) contacts, one sense contact and an additional single ground contact connected directly with the printed circuit board. A second or redundant ground contact is used which is integrated into the rear metallic casting of the electronic device. In that redundant ground contact on the casting, electronic parts can be placed directly below the redundant contact on the printed circuit (PC) board. This ultimately saves valuable PC board space while still providing contact redundancy and continuous continuity during a high stress condition such as a drop onto a hard surface.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

We claim:

1. A power and grounding contact assembly for use in an electronic device comprising:

a battery contact block including a plurality of cantilevered contacts coupled to a printed circuit board of the electronic device;

a redundant ground contact connected to the metallic housing of the electronic device and positioned adjacent to the battery contact block; and wherein the plurality of cantilevered contacts includes a primary power contact, a sensing contact and a ground contact.

2. A power and grounding contact assembly as in claim 1, wherein the redundant ground contact is a resilient lug connected to the metallic housing with a mechanical fastener.

3. A power and grounding contact assembly as in claim 1, wherein the battery contact block is partially exposed through the metallic housing of the electronic device.

4. A power and grounding contact assembly as in claim 1, wherein a raised portion of the plurality of cantilevered contacts are exposed through the contact block.

5. A power and grounding contact assembly as in claim 1, wherein the plurality of cantilevered contacts includes a u-shaped fastener section and a contact section projecting therefrom.

6. A power and grounding contact assembly as in claim 1, wherein the primary power contact is a double contact.

7. A power and grounding contact assembly as in claim 1, wherein the electronic device is a two-way radio transceiver.

8. A battery contact assembly for an electronic device having high reliability for maintaining electrical continuity under a high stress load condition comprising:

a contact header having at least a primary battery contact; a sensing contact and a first ground contact coupled to a printed circuit board of the electronic device;

a second ground contact fastened to a metallic housing of the electronic device and positioned adjacent to the contact header for providing a redundant grounding connection; and wherein the primary battery contact, sensing contact and first ground contact include a cantilevered section for providing resiliency when under compression.

9. A battery contact assembly as in claim 8, wherein the cantilevered section includes a u-shaped fastener portion and a contact portion for projecting through an aperture in the electronic device.

10. A battery contact assembly as in claim 8, wherein the primary battery contact is a double contact for providing redundancy.

11. A battery contact assembly as in claim 8, wherein the second ground contact is a contact lug having a resilient section projecting away from the metallic housing.

12. A battery contact assembly as in claim 8, wherein the primary battery contact, sensing contact and first ground contact are substantially rectangular.

13. A battery contact assembly as in claim 8, wherein the electronic device is a two-way radio transceiver.

14. A method for forming a power and grounding contact assembly for use in an electronic device comprising:

providing a battery contact block having a plurality of cantilevered contacts coupled to a printed circuit of the electronic device;

positioning a redundant ground contact connected to a metallic housing of the electronic device adjacent to the battery contact block; and utilizing the plurality of cantilevered contacts as a primary power contact, a sensing contact and a ground contact.

15. A method for forming a power and grounding contact assembly as in claim 14, further comprising the step of:

utilizing a resilient lug connected to the metallic housing as the redundant ground contact.

16. A method for forming a power and grounding contact assembly as in claim 14, further comprising the step of:

partially exposing the battery contact block through the metallic housing of the electronic device.

17. A method for forming a power and grounding contact assembly as in claim 14, further comprising the step of:

exposing through the contact block a raised section of the plurality of cantilevered contacts.

18. A method for forming a power and grounding contact assembly as in claim 14, further comprising the step of:

forming the plurality of cantilevered contacts into a unshaped fastener section and a contact section.

19. A method for forming a power and grounding contact assembly as in claim 14, further comprising the step of:

forming the primary power contact into a double raised section for redundancy.

* * * * *